US012091755B2

(12) United States Patent
Liu

(10) Patent No.: US 12,091,755 B2
(45) Date of Patent: Sep. 17, 2024

(54) ALUMINUM ALLOY HUB AND METHOD FOR COATING SURFACE OF ALUMINUM ALLOY HUB

(71) Applicant: CITIC Dicastal Co., Ltd., Qinhuangdao (CN)

(72) Inventor: Ziguang Liu, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 260 days.

(21) Appl. No.: 17/775,447

(22) PCT Filed: Oct. 16, 2020

(86) PCT No.: PCT/CN2020/121503
§ 371 (c)(1),
(2) Date: May 9, 2022

(87) PCT Pub. No.: WO2021/135511
PCT Pub. Date: Jul. 8, 2021

(65) Prior Publication Data

US 2022/0403496 A1 Dec. 22, 2022

(30) Foreign Application Priority Data

Dec. 31, 2019 (CN) ..... 201911420043.4

(51) Int. Cl.

| | |
|---|---|
| ***C23C 4/10*** | (2016.01) |
| ***C22C 21/00*** | (2006.01) |
| ***C23C 4/06*** | (2016.01) |
| ***C23C 4/129*** | (2016.01) |
| ***C23C 4/18*** | (2006.01) |
| ***C23C 24/00*** | (2006.01) |

(52) U.S. Cl.
CPC ..... *C23C 4/10* (2013.01); *C22C 21/00* (2013.01); *C23C 4/06* (2013.01); *C23C 4/129* (2016.01); *C23C 4/18* (2013.01); *C23C 24/00* (2013.01)

(58) Field of Classification Search
None
See application file for complete search history.

(56) References Cited

U.S. PATENT DOCUMENTS

2013/0177437 A1* 7/2013 Amancherla ..... C23C 4/02 416/241 R
2020/0362453 A1* 11/2020 Li ..... C23C 14/165

* cited by examiner

*Primary Examiner* — Shamim Ahmed
*Assistant Examiner* — Bradford M Gates
(74) *Attorney, Agent, or Firm* — IPro, PLLC

(57) ABSTRACT

The application relates to an aluminum alloy hub and a method for coating the surface of the aluminum alloy hub. The aluminum alloy hub is provided with an aluminum alloy matrix and a coating attached to the surface of the aluminum alloy matrix, and the coating sequentially includes a pre-coating layer formed by nickel-coated aluminum or aluminum-coated nickel powder, a $Cr_3C_2$ layer and a varnish layer on the surface of the aluminum alloy matrix. According to the aluminum alloy hub disclosed by the invention, more excellent corrosion resistance is obtained by spraying the $Cr_3C_2$ layer on the surface of the aluminum alloy hub.

12 Claims, 1 Drawing Sheet

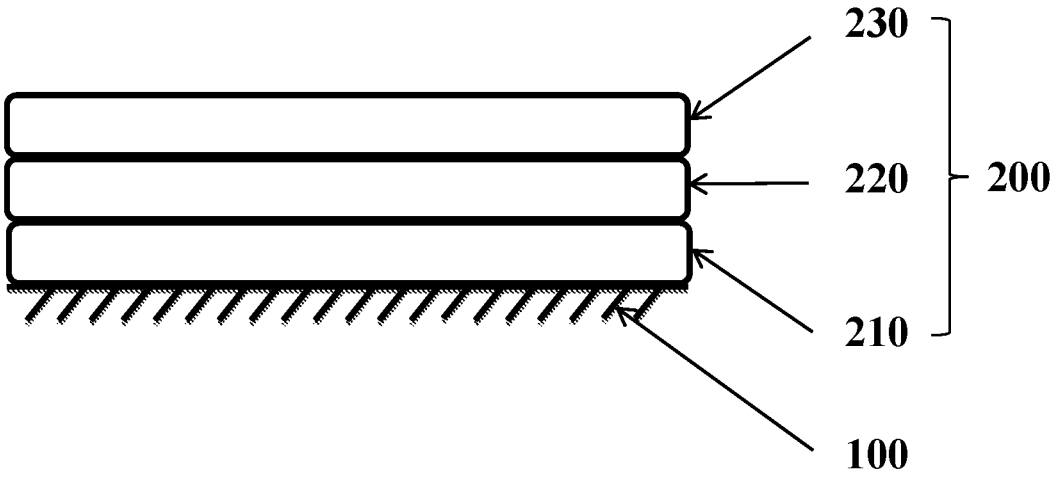
230
220
200
210
100

ALUMINUM ALLOY HUB AND METHOD FOR COATING SURFACE OF ALUMINUM ALLOY HUB

TECHNICAL FIELD

The invention belongs to the field of aluminum alloy hub surface treatment, and particularly relates to an aluminum alloy hub and a method for coating the surface of the aluminum alloy hub.

BACKGROUND

An aluminum alloy hub has the advantages of oil saving, good heat dissipation, long service life of an engine, good roundness, firmness, durability and the like, and is widely applied to the automobile industry. an electroplated automobile aluminum hub has more attractive appearance, and becomes fashionable in developed countries and regions such as European, Japan, Korea, America and the like.

The surface of the aluminum alloy hub is generally treated through methods such as coating, film plating and electroplating, so that an anti-corrosion effect and a decoration effect can be achieved.

With the improvement of living standards and taste, the electroplated automobile aluminum hub also has a huge market prospect in China. However, the electroplated aluminum alloy hub is more and more complex in appearance and high in quality requirement. Chinese patent application CN103320791A discloses an electroplating method of an aluminum alloy hub. Firstly, the aluminum alloy hub is pretreated; secondly, the aluminum alloy hub is immersed in phosphoric acid for 5-10 min for surface activation; then a layer of epoxy polyester powder is sprayed on the surface of the aluminum alloy hub by adopting an electrostatic spraying method; then nickel plating is carried out twice; and finally, vacuum chromium plating is carried out. However, the electroplating process is complex, and waste liquid generated after electroplating causes great pollution to the environment, which does not conform to an energy-saving and environment-friendly policy advocated by the country.

Chinese patent application CN105525266A discloses a vacuum coating process for an aluminum alloy hub. The process includes the steps that firstly, the aluminum alloy hub is pretreated; secondly, epoxy resin is sprayed to the aluminum alloy hub through an electrostatic spraying method; then grinding and cleaning the powder; then the aluminum alloy hub is coated with a film through a vacuum coating method, wherein a coating material is an alloy coating material and includes aluminum, iron, nickel and chromium; and finally, finishing varnish is sprayed to the aluminum alloy hub. In the application, the bonding strength between the aluminum alloy hub and the coating is improved through the four main procedures of pretreatment, electrostatic spraying, vacuum coating and finishing varnish spraying, and the corrosion resistance of the aluminum alloy hub is enhanced. However, the cost of the vacuum coating method is high.

SUMMARY

In view of this, a main purpose of the invention is to provide a low-cost and environment-friendly aluminum alloy hub surface treatment method so as to form an aluminum alloy hub with improved corrosion resistance.

In a first aspect, the invention provides an aluminum alloy hub provided with an aluminum alloy matrix and a coating attached to the surface of the aluminum alloy matrix, wherein the coating sequentially includes a pre-coating layer formed by nickel-coated aluminum or aluminum-coated nickel powder, a $Cr_3C_2$ layer and a varnish layer on the surface of the aluminum alloy matrix.

According to one embodiment of the invention, the thickness of the pre-coating layer may be 0.05-0.08 mm.

According to one embodiment of the invention, the thickness of the $Cr_3C_2$ layer may be 0.10-0.06 mm, preferably 0.08 mm.

Further, the porosity of the $Cr_3C_2$ layer may be 1.5-2.5%, preferably 1.8-2.0%.

According to one embodiment of the invention, the thickness of the varnish layer may be 0.40-0.08 mm.

In a second aspect, the invention provides a method for coating the surface of an aluminum alloy hub, wherein the method includes the steps of pretreating the surface of the aluminum alloy hub, spraying a pre-coating layer, spraying a $Cr_3C_2$ layer and conducting aftertreatment, and the step of spraying the $Cr_3C_2$ layer includes forming the $Cr_3C_2$ layer with a thickness greater than or equal to 0.15 mm on the surface of the aluminum alloy hub by adopting a high-speed flame spraying method, and conducting finish turning to a predetermined thickness.

According to one embodiment of the invention, the step of pretreating may include conducting cleaning of degreasing, decontaminating and derusting, roughening and preheating on the surface of the aluminum alloy hub.

According to one embodiment of the invention, the step of spraying the pre-coating layer may includes forming the pre-coating layer with a thickness of 0.12-0.13 mm on the surface of the aluminum alloy hub by adopting a high-speed flame spraying method, and turning and roughening the pre-coating layer to be 0.05-0.08 mm, and preferably, the pre-coating layer is formed by nickel-coated aluminum or aluminum-coated nickel powder.

According to one embodiment of the invention, the step of aftertreatment may includes: carrying out sand blasting treatment by using silica sand with a particle size of 0.5-1.0 mm, and then spraying finishing varnish for decoration.

According to the aluminum alloy hub disclosed by the invention, through the surface treatment method for spraying the $Cr_3C_2$ layer on the surface of the aluminum alloy hub, the cost is reduced, pollution in an electroplating method is avoided, and more excellent corrosion resistance is obtained.

BRIEF DESCRIPTION OF THE DRAWINGS

FIG. 1 is a partial cross-sectional schematic diagram of an aluminum alloy hub according to the present invention.

DETAILED DESCRIPTION

The technical solutions in the embodiments of the invention are clearly and completely described in combination with the embodiments of the invention and an accompanying drawing of the invention, and obviously, the described embodiments are only a part of the embodiments of the invention, but not all the embodiments of the invention. Based on the embodiments of the present invention, other embodiments obtained by those of ordinary skill in the art without creative work all belong to the scope of protection of the present invention.

The drawing in the invention is only a schematic structure diagram, wherein the size and the shape do not represent the real size and shape.

As shown in FIG. 1, an aluminum alloy hub is provided with an aluminum alloy matrix 100 and a coating 200 attached to the surface of the aluminum alloy matrix, and the coating 200 sequentially includes a pre-coating 210 formed by nickel-coated aluminum or aluminum-coated nickel powder, a $Cr_3C_2$ layer 220 and a varnish layer 230 on the surface of the aluminum alloy matrix 100. Preferably, the thickness of the pre-coating layer 210 may be 0.05-0.08 mm. Preferably, the thickness of the $Cr_3C_2$ layer 220 may be 0.10-0.06 mm, more preferably 0.08 mm. Preferably, the porosity of the $Cr_3C_2$ layer 220 may be 1.5-2.5%, more preferably 1.8-2.0%. Preferably, the thickness of the varnish layer 230 may be 0.40-0.08 mm.

The invention provides a method for coating the surface of an aluminum alloy hub. According to the method, a compact chromium carbide layer is formed on the surface of an aluminum alloy matrix through a high-speed flame spraying method, so that the cost of surface treatment of the aluminum alloy hub is reduced, and improved corrosion resistance is obtained.

According to one specific embodiment of the invention, the method disclosed by the invention is described in detail below in combination with FIG. 1.

Firstly, the surface of an aluminum alloy matrix 100 is pretreated. The pretreatment step includes the steps that the surface of the aluminum alloy hub is cleaned by degreasing, decontaminating and derusting, and oxide skin on the surface of the aluminum alloy hub is removed, so that the surface of a workpiece shows metallic luster; then, the surface is roughened through turning, so that the surface quality is further guaranteed, the bonding strength is improved, and the thickness of the coating is reserved; and then the aluminum alloy hub is preheated at 120-140° C. through a resistance furnace, so that the temperature of the workpiece is uniform, and water vapor is not generated on the surface.

Then the pre-coating layer 210 is sprayed by adopting a high-speed flame spray gun. The process parameters are shown in the following table, the thickness of the sprayed pre-coating layer is 0.12-0.13 mm, the thickness of the pre-coating layer after turning and roughening is 0.05-0.08 mm, and preferably, the pre-coating layer 210 may be formed by nickel-coated aluminum or aluminum-coated nickel powder.

Then, the high-speed flame spray gun is still adopted for spraying the $Cr_3C_2$ layer 220. The process parameters are shown in the following table, and the thickness of the sprayed $Cr_3C_2$ layer 220 is greater than or equal to 0.15 mm.

| Oxygen pressure (MPa) | Compressed air pressure (MPa) | Acetylene pressure (MPa) | Spraying distance (mm) | Spraying angle (°) |
|---|---|---|---|---|
| 0.45-0.48 | 0.42-0.44 | 0.55-0.58 | 160-170 | 26-28 |
| 0.42-0.49 | 0.40-0.45 | 0.52-0.60 | 150-180 | 26-28 |

Finally, the surface of the aluminum alloy hub is subjected to aftertreatment, and sand blasting is conducted by using silica sand of 0.5-1.0 mm; after finish turning, the thickness of the $Cr_3C_2$ layer 220 is about 0.08 mm; and finally, finishing varnish 230 is sprayed for decoration, the thickness of the varnish layer is 0.40-0.08 mm, and the thickness of the varnish layer in specific production is within a range value.

The present invention is further described hereinafter with specific embodiments. The reagents used in the following embodiments are all commercially available and purchased.

Embodiment Spraying Cr3C2 powder on the surface of an aluminum alloy sample block by adopting a high-speed flame spraying method 1. Test Equipment:
   - Equipment: SQP-1 type flame spray gun (manufacturer: Shanghai Ouya spraying machinery Co., Ltd.)
   - Workpiece: aluminum alloy hub base material sample block
   - Priming layer material: aluminum-coated nickel powder (particle size No.: 230-240, and particle size: 15 μm)
   - Spraying material: $Cr_3C_2$ powder (particle size: 10 μm)
2. Test Method The surface of an aluminum alloy sample block is degreased, decontaminated and derusted. Then roughening treatment is carried out by adopting a turning process. A resistance furnace is adopted for preheating at 120-140° C. for 5 min.

A high-speed flame spray gun is adopted for spraying a pre-coating layer according to the following conditions, wherein the thickness is 0.12-0.13 mm. Then turning and roughening are conducted again. The remaining thickness is 0.05 mm. $Cr_3C_2$ powder with a thickness of 0.15 mm is sprayed by adopting a high-speed flame spray gun according to the following conditions. Then silica sand with a particle size of 0.5-1.0 mm is adopted for conducting sand blasting aftertreatment on the surface of the $Cr_3C_2$, and after finish turning, the thickness of the $Cr_3C_2$ layer is 0.08 mm. Finally, finishing varnish is sprayed for decoration.

Process parameters for spraying the pre-coating layer and a working layer are as follows:

| Spraying material | Oxygen pressure (MPa) | Compressed air pressure (MPa) | Acetylene pressure (MPa) | Spraying distance (mm) | Spraying angle (°) |
|---|---|---|---|---|---|
| Aluminum-coated nickel powder | 0.45-0.48 | 0.42-0.44 | 0.55-0.58 | 160-170 | 26-28 |
| $Cr_3C_2$ powder | 0.42-0.49 | 0.40-0.45 | 0.52-0.60 | 150-180 | 26-28 |

Comparative Example Electroplating the Surface of an Aluminum Alloy Sample Block by Using an Electroplating Method A conventional electroplating method is adopted, surface electroplating is conducted on an aluminum alloy sample block used for preparing an aluminum alloy hub according to a technological process of polishing, pretreatment, cleaning, activation, oil removal, semi-bright nickel plating, high-sulfur nickel plating, bright nickel plating, chromium plating and inspection, and an electroplated sample block with the following structure is obtained:

Electroplated Layer Thickness:

- a chromium layer: 0.25-0.40 μm;
- a microporous nickel layer (without minimum requirements, but STEP requirements must be met);

a bright nickel layer: 16 μm (minimum);

a high sulfur nickel layer (without minimum requirements, but STEP requirements must be met);

a semi-bright nickel layer: 24 μm (minimum);

the thickness of a copper layer is 10 μm (minimum);

the total nickel layer thickness is 40 μm (minimum); and the total coating thickness is 50 μm (minimum).

Test Example 1 Performance Test of Coatings in Embodiment and Comparative Example 1. Test Method and Instrument Density: detected by a metallographic method (Zeiss metallographic microscope)

Porosity: detected by a metallographic method (Zeiss metallographic microscope)

Bonding strength: tested by using a stretcher (German Zwick/Z100)

A density/porosity detection method: a hub coating section is taken, mounting, grinding and polishing are conducted, the section is viewed under a 200-fold microscope, and checking is conducted.

A bonding strength detection method: a tensile sample is made of common Q235 steel through turning. Specific test steps are as follows: sand blasting treatment is performed on a sample mating plate A and a sample mating plate B, a coating with a bonding strength to be detected is uniformly sprayed on the end surface of the test piece A, wherein the thickness is about 0.8 mm, the test piece A and the test piece B are bonded by using E-7 glue, wherein the test piece A is placed on the test piece B, and the test piece A and the test piece B are enabled to be coaxial, thermal curing is conducted at 100° C. for 1 h, the test piece is clamped on a clamp of a testing machine, and stretched at a speed of 1 m/min, the magnitude of a load applied is recorded when the test piece is stretched to be broken, and meanwhile, the peeling condition of the coating on the end surface of the test piece is observed when the test piece is stretched to be broken.

2. Test Results

| | Structure | Density | Bonding strength | Porosity |
|---|---|---|---|---|
| Comparative example | Epoxy resin/nickel/nickel/chromium | 76% | 66 MPa | 3.2% |
| Embodiment | Pre-coating layer: 0.05 mm $Cr_3C_2$ layer: 0.08 mm | 90-95% | 92 MPa | 2.5% |

Test Example 2 Test of Corrosion Resistance of Coatings in Embodiment and Comparative Example 1. Test Method A copper accelerated acetic acid salt spray (CASS) test (ISO9227-2006) is carried out for 240 h by adopting salt spray chamber equipment (manufacturer: ATLAS, and trade mark: FS-2000).

2. Test Results

| | First stage | Second stage | Third stage |
|---|---|---|---|
| Comparative example | No change within 66 h | Having a corrosion spot at 120 h | Severe corrosion at 168 h |

-continued

| | First stage | Second stage | Third stage |
|---|---|---|---|
| Embodiment | No change within 66 h | No change within 120 h | No corrosion within 240 h |

The above are only the preferred embodiments of the invention, and does not limit the patent range of the invention, and the equivalent structure transformation made by using the contents of the description and the drawing of the invention or the direct/indirect application in other related technical fields under the conception of the invention is included in the patent protection range of the invention.

The invention claimed is:

1. An aluminum alloy hub provided with an aluminum alloy matrix and a coating attached to a surface of the aluminum alloy matrix, characterized in that the coating sequentially comprises a pre-coating layer formed by nickel-coated aluminum or aluminum-coated nickel powder, a $Cr_3C_2$ layer and a varnish layer on the surface of the aluminum alloy matrix.

2. The aluminum alloy hub according to claim 1, characterized in that the pre-coating layer has a thickness of 0.05-0.08 mm.

3. The aluminum alloy hub according to claim 1, characterized in that the $Cr_3C_2$ layer has a thickness of 0.06-0.10 mm.

4. The aluminum alloy hub according to claim 1, characterized in that the $Cr_3C_2$ layer has a porosity of 1.5-2.5%.

5. The aluminum alloy hub according to claim 1, characterized in that the varnish layer has a thickness of 0.08-0.40 mm.

6. The aluminum alloy hub according to claim 1, characterized in that the $Cr_3C_2$ layer has a thickness of 0.08 mm.

7. The aluminum alloy hub according to claim 1, characterized in that the $Cr_3C_2$ layer has a porosity of 1.8-2.0%.

8. A method for coating the surface of an aluminum alloy hub, characterized in that the method comprises the steps of pretreating a surface of the aluminum alloy hub, spraying a pre-coating layer, spraying a $Cr_3C_2$ layer, and conducting aftertreatment, wherein the step of spraying the $Cr_3C_2$ layer comprises forming the $Cr_3C_2$ layer with a thickness greater than or equal to 0.15 mm on the surface of the aluminum alloy hub by adopting a high-speed flame spraying method, and conducting finish turning to a predetermined thickness.

9. The method for coating the surface of the aluminum alloy hub according to claim 8, characterized in that the step of pretreating comprises conducting cleaning, roughening and preheating on the surface of the aluminum alloy hub, wherein the cleaning process comprises degreasing, decontaminating and derusting.

10. The method for coating the surface of the aluminum alloy hub according to claim 8, characterized in that the step of spraying the pre-coating layer comprises: forming the pre-coating layer with a thickness of 0.12-0.13 mm on the surface of the aluminum alloy hub by adopting a high-speed flame spraying method, and turning and roughening the pre-coating layer to be 0.05-0.08 mm.

11. The method for coating the surface of the aluminum alloy hub according to claim 8, characterized in that the step of aftertreatment comprises: carrying out sand blasting treatment by using silica sand with a particle size of 0.5-1.0 mm, and then spraying finishing varnish for decoration.

12. The method for coating the surface of the aluminum alloy hub according to claim 8, characterized in that the pre-coating layer is formed by nickel-coated aluminum or aluminum-coated nickel powder.

* * * * *